United States Patent [19]

Wahlström

[11] Patent Number: 4,644,770

[45] Date of Patent: Feb. 24, 1987

[54] METHOD AND APPARATUS FOR PRODUCING SPACERS OR BLOCKS PRIMARILY FOR USE IN LOAD PALLET STRUCTURES

[75] Inventor: Olle L. W. Wahlström, Katrineholm, Sweden

[73] Assignee: Lars Hammarberg, Switzerland

[21] Appl. No.: 692,889

[22] PCT Filed: Apr. 13, 1984

[86] PCT No.: PCT/SE84/00141

§ 371 Date: Dec. 13, 1984

§ 102(e) Date: Dec. 13, 1984

[87] PCT Pub. No.: WO84/04082

PCT Pub. Date: Oct. 25, 1984

[30] Foreign Application Priority Data

Apr. 14, 1983 [SE] Sweden ..... 8302088

[51] Int. Cl.[4] ..... B21D 39/03; B21D 51/12; B21D 13/04

[52] U.S. Cl. ..... 72/51; 72/133; 72/196

[58] Field of Search ..... 29/21.1, 149.5 C, 149.5 S, 29/432, 798; 72/51, 130, 132, 133, 149, 168, 182, 196, 197, 368

[56] References Cited

U.S. PATENT DOCUMENTS

| | | | |
|---|---|---|---|
| 262,723 | 8/1882 | Austin | 72/168 |
| 1,731,478 | 10/1929 | Widell | 72/51 X |
| 2,001,553 | 5/1935 | Spencer | 72/196 X |
| 3,129,489 | 4/1964 | Nelson | 29/21.1 |
| 3,208,140 | 9/1965 | Mayrath | 72/197 X |
| 3,447,352 | 6/1969 | Miller | 72/196 X |

FOREIGN PATENT DOCUMENTS

| | | | |
|---|---|---|---|
| 1096821 | 6/1955 | France | 72/149 |

*Primary Examiner*—E. Michael Combs

*Attorney, Agent, or Firm*—Ostrolenk, Faber, Gerb & Soffen

[57] ABSTRACT

The present invention relates to a method and apparatus for producing spacers or blocks preferably for use in pallet structures as supporting elements for the deck and/or as blocks between load deck and stringers, said blocks consisting of sleeves made from sheet metal. An elongate, substantially rectangular sheet metal blank (11) is fed into a nip (7) formed by at least two corrugated rolls (1, 2) with its main plane inclined to the plane passing through the axes of the rolls. The front end (17) of the blank (11) is fixed in a groove (12) in the surface of the roll (1). When the rolls (1, 2) are rotated, the blank (11) is shaped in the roll nip (7) and is rolled on to the roll (1). After the rolls (1, 2) have rotated at least one revolution, the ready-shaped block is withdrawn or pushed from the roll (1) in an axial direction.

2 Claims, 4 Drawing Figures

Figure 1:
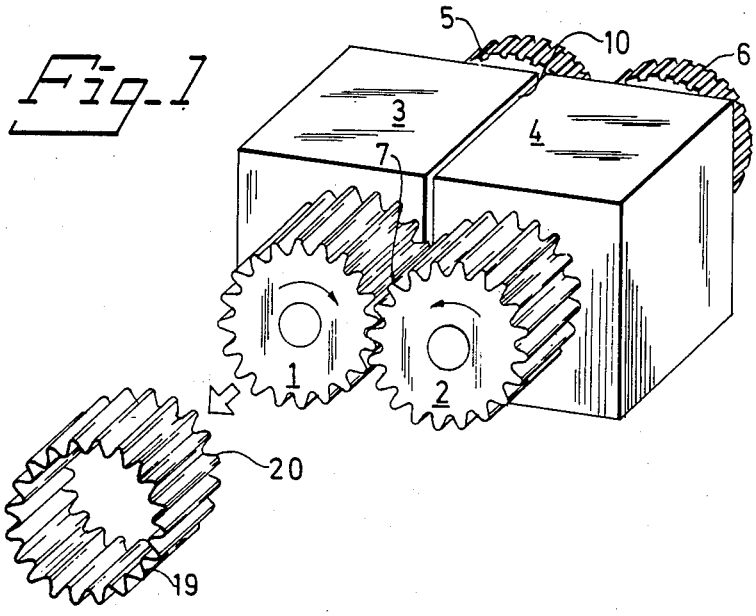

METHOD AND APPARATUS FOR PRODUCING SPACERS OR BLOCKS PRIMARILY FOR USE IN LOAD PALLET STRUCTURES

The present invention relates to a method and apparatus for producing spacers or blocks primarily for use in load pallet structures, as supporting element for the load deck and/or as blocks between load deck and stringers, the blocks consisting of sleeves made from sheet metal.

Spacers or blocks of this type, which are incorporated in pallet structures are already described in a published Swedish patent application. The invention according to the latter relates to a method of manufacturing pallets by machine and a pallet manufactured according to the method, said pallets being provided with a deck supported by spacers or blocks and/or stringers. The blocks and/or stringers are preferably combined with fastening means for joining the blocks to the deck, this process taking place in a compression and joining station, the pressing together of deck and blocks taking place in a roll nip under a pressure of sufficient magnitude for causing the blocks to penetrate into the load deck, at least with its upper portion, to a depth such that fixation against rotation of the blocks in relation to its fixed position against the load deck is obtained. Since a pallet is a product which is mass produced today, it is essential that the manufacture of the blocks included in a pallet can be manufactured efficiently, cheaply and at high speed.

The present invention has the object of providing a method of producing spacers or blocks of the type mentioned in the introduction. What is essentially distinguishing for the invention here is that an elongate, substantially rectangular sheet metal blank is fed into a nip formed by at least two corrugated rolls, with its main plane inclined to the plane passing through the axes of the rolls, that the front edge of the blank is fixed at the surface of one roll, that the rolls are subsequently caused to rotate at least one revolution simultaneously as the blank is given a corrugated configuration on its passage through the nip substantially corresponding to the configuration of the corrugations on the rolls, that after fixation of the front edge of the blank against the surface of one roll, and after shaping in the roll nip, the blank is brought into engagement against said surface and accompanies the direction of rotation of the roll until the blank has assumed its sleevelike shape on the roll and that the block is then withdrawn or pushed from the roll in an axial direction.

The present invention also has the object of providing an apparatus for carrying out the above-mentioned method, essentially distinguishing for this apparatus being that it includes at least two opposing, corrugated rolls, the corrugations of which are arranged for meshing and are at a pre-determined distance from each other to make a roll nip for shaping a sheet metal blank, said distance between the corrugations of the surfaces being somewhat larger than the thickness of the sheet metal to be shaped.

By reason of the invention the production of spacers or blocks preferably for use in pallet structures can take place efficiently and economically. The rate of production is as high as 20–30 sleeves per minute. This is feasible, inter alia since the corrugation and circular bending of the block takes place at the same operation. Furthermore, riveting the overlapping portions of the sheet is carried out during the actual shaping of the block. Since a riveting method is used, galvanized sheet can also be used, which is to be preferred because of the many advantages of this material in relation to untreated or painted sheet metal.

Figure 3:
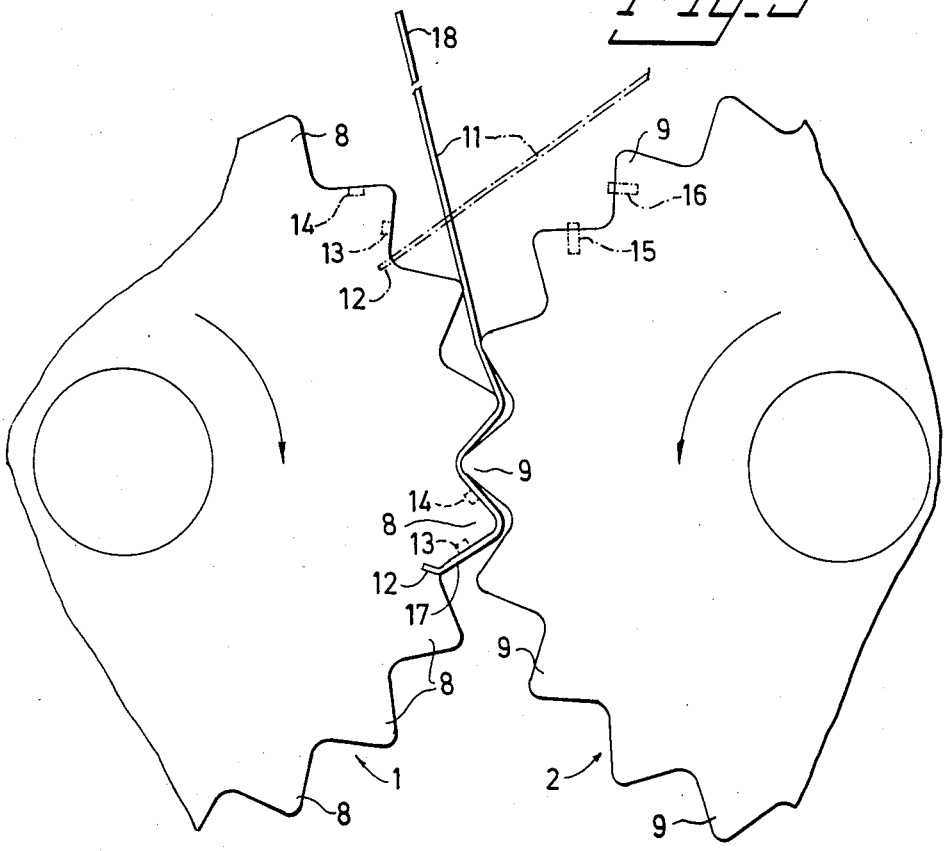
Figure 2:
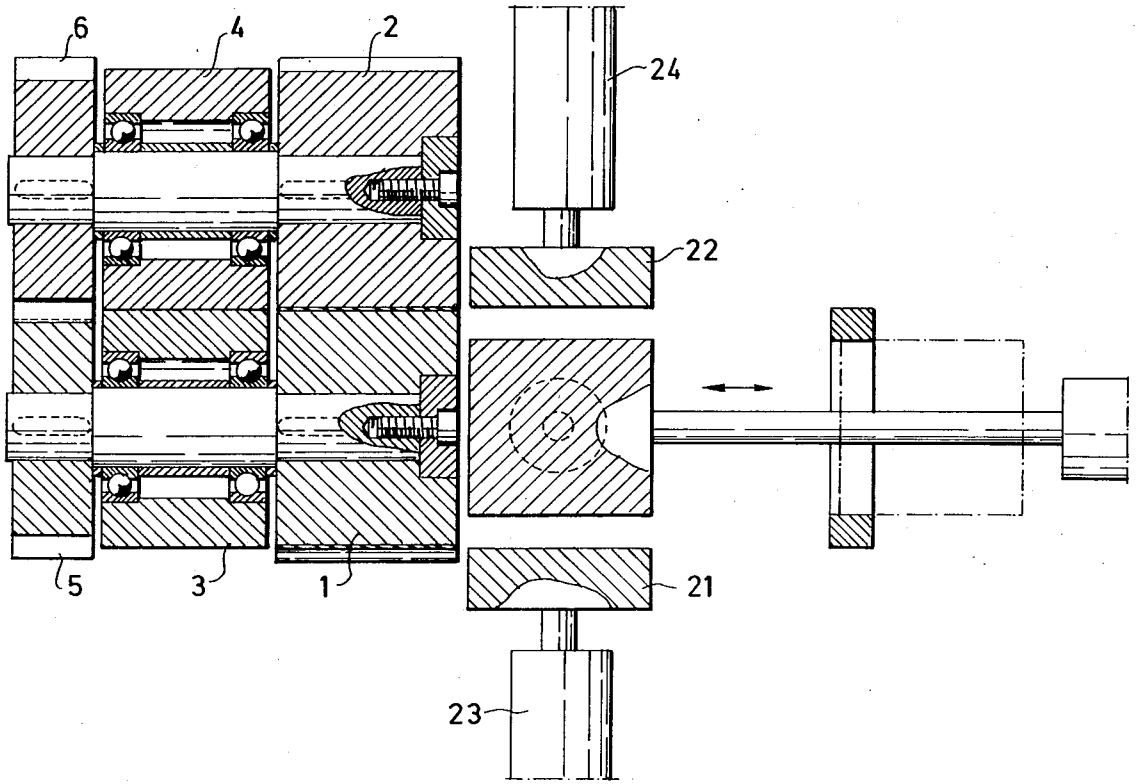
Figure 4:
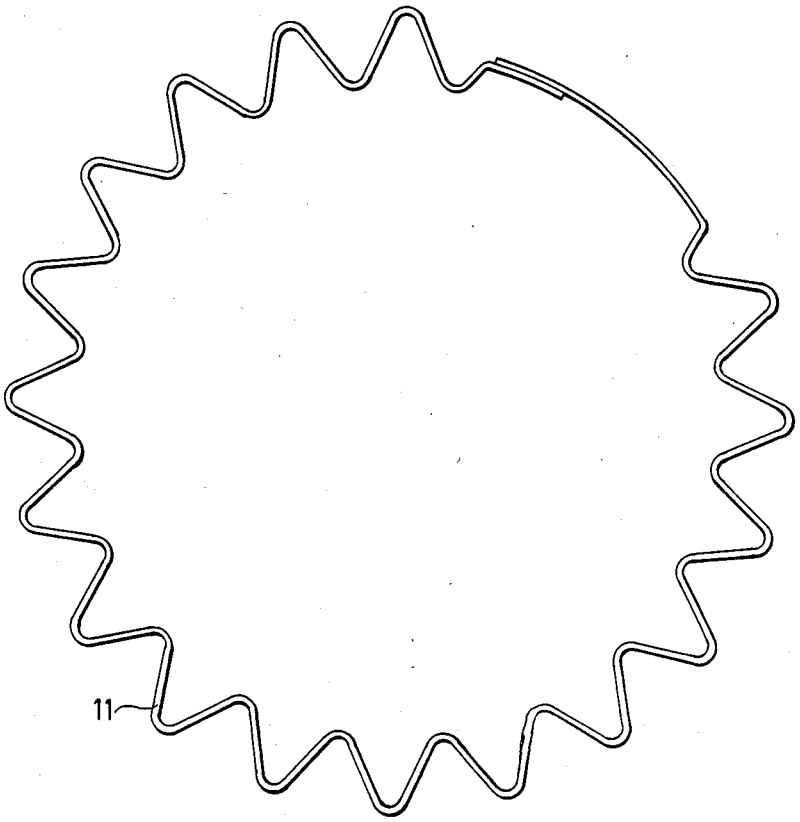

The invention will now be described in detail with reference to the appended drawings, on which FIG. 1 schematically illustrates a perspective view of an apparatus for carrying out the method in accordance with the invention, FIG. 2 is a side view of the apparatus illustrated in FIG. 1, FIG. 3 illustrates in a side view how the shaping of the sheet metal blank takes place with the apparatus illustrated in FIGS. 1 and 2, and FIG. 4 is a side view of an alternative embodiment of a sleeve, shaped and riveted together with the aid of an apparatus in accordance with the invention.

FIG. 1 schematically illustrates a suitable apparatus for carrying out the method in accordance with the present invention, this apparatus comprising two shaping rolls 1 and 2, each mounted in a bearing housing 3 and 4, respectively. Rotation of the rolls 1 and 2 may be provided with the aid of gears 5, 6 driven by a means not illustrated in the Figure. The surfaces of the rolls 1 and 2 are corrugated and together form a roll nip 7, the rolls being spaced from each other so that the corrugations or teeth 8, 9, constituting the surfaces of the rolls 1, 2 do not come into contact with each other. By each of the rolls 1, 2 having its own bearing housing 3, 4 the spacing between the rolls can easily be regulated by shims or spacers 10 between the housings, which consequently affects the spacing between the rolls 1 and 2. A preferred spacing between the teeth or corrugations 8, 9 of the rolls is one which is somewhat greater than twice the thickness of the sheet metal blank 11 which is to be shaped. In its surface between two adjacent teeth 8 one roll 1 is formed with an axial groove 12 of a width substantially corresponding to the thickness of the sheet metal. The groove 12 is intended for locating the front edge 17 of the sheet 11 before the sheet is fed into the roll nip 7. The groove 12 extends along the entire length of the roll 1 in its axial direction, right out to its free end so that the sheet 11 shaped between the rolls can be withdrawn axially from the roll 1. The tooth or corrugation 8 adjacent the groove 12 is formed with two axial grooves 13, 14 intended to co-act with hard metal pins 15, 16 projecting from the opposing roll 2 for riveting together the overlapping portions of the sheet metal blank 11.

As will be seen in principle from FIG. 3, an elongate, substantially rectangular sheet metal blank 11 is advanced with its main plane inclined to the plane through the axes of the rolls into the nip formed by the two corrugated rolls 1 and 2. The long sides 19, 20 of the blank 11 which extend in the advancing direction as the blank is advanced towards the nip 7, and after shaping the block form its end edge portions are conventionally formed with a sawtooth-like contour before the blank 11 is advanced into the nip 7. After the front edge 17 of the blank 11 has been located in the groove 12, the rolls 1, 2 are caused to rotate at least one revolution, whereby the blank 11 during its passage through the nip 7 is given a corrugated configuration substantially corresponding to the form of the corrugations or teeth 8, 9 on the rolls 1, 2. After shaping in the nip 7 the blank 11 surrounds the roll 1. In conjunction with the front edge 17 of the blank 11 being rotated one revolution, this edge being overlapped by the rear edge 18 of the blank 11, the overlapping portions are riveted together with the aid of the hard metal pins 15 and 16, which deform the sheet metal and impress it into the grooves 13, 14 in the roll 1. An impression in the sheet metal also takes place at the front edge 17 directly after the start of rotation of the roll 1, and due to this so-called pre-impression of the sheet metal, better riveting of the rear edge 18 is achieved than would otherwise be the case.

After the rolls 1 and 2 have rotated at least one revolution, and the riveting has been accomplished, the block is withdrawn or pushed from the roll 1 with the aid of suitable means not illustrated in the figures. Should a cross-sectional shape other than round be desired, e.g. oval, this can be achieved by a subsequent mechanical compression of the block between compression jaws 21, 22 which are arranged for urging against each other with the aid of hydraulic cylinders 23, 24.

I claim:

1. A method for producing supporting elements for use in pallet structures in one continuous operation at a single work station, comprising the steps of:

(a) advancing an elongate, substantially rectangular sheet metal blank into a nip formed by first and second corrugated rolls with the main plane of said blank inclined relative to the plane passing through the axes of the rolls such that the front edge of the blank is located and secured in an axial groove formed in the surface of said first roll;

(b) rotating said rolls at least one revolution such that said blank is given a corrugated configuration as it passes through said nip formed by said rolls, said corrugated configuration corresponding substantially to the shape of the corrugations on said rolls, said corrugated blank being brought into engagement as it is shaped against the surface of said first roll by the fixation of said front edge of said blank in said groove, said corrugated blank thereby acquiring a sleeve-like shape on said first roll, the portion of said blank adjacent the front edge of said blank overlapping the portion of said blank adjacent the rear edge of said blank after said first roll has been rotated one revolution;

(c) riveting the portion of said blank adjacent the front edge of said blank to the portion of said blank adjacent the rear edge of said blank with hard metal pins projecting from the surface of said second roll, said pins punching through said corrugated sheet and pressing into corresponding axial grooves disposed in the surface of said first roll, said grooves being located on said first roll such that they coincide in position with said pins when said rolls are rotated; and (d) axially withdrawing said corrugated and riveted blank from said first roll.

2. An apparatus for producing supporting elements for use in pallet structures in one continuous operation at a single work station, comprising first and second opposing corrugated rolls adapted for meshing with each other on rotation without the surfaces of the rolls coming into contact, for the formation of a roll nip for corrugating a sheet metal blank;

said first roll having formed in its surface;

(a) a first axial groove for locating and securing the front edge of said blank before the blank is fed into said roll nip and during the entire shaping procedure;

(b) at least one additional axial groove disposed a short distance behind said first axial groove in the rotational direction of said first roll for co-acting with at least one corresponding hard metal pin projecting from said second corrugated roll for riveting together the portions of said blank which overlap when said blank has been corrugated by a rotation of revolution of said first and second rolls.

* * * * *